US010751599B1

(12) United States Patent
Whitfield

(10) Patent No.: US 10,751,599 B1
(45) Date of Patent: Aug. 25, 2020

(54) GOLF PUTTING ALIGNMENT APPARATUS

(71) Applicant: Richard A. Whitfield, Hobe Sound, FL (US)

(72) Inventor: Richard A. Whitfield, Hobe Sound, FL (US)

( * ) Notice: Subject to any disclaimer, the term of this patent is extended or adjusted under 35 U.S.C. 154(b) by 0 days.

(21) Appl. No.: 16/740,043

(22) Filed: Jan. 10, 2020

(51) Int. Cl.
*A63B 69/36* (2006.01)

(52) U.S. Cl.
CPC .. *A63B 69/3676* (2013.01); *A63B 2069/3679* (2013.01)

(58) Field of Classification Search
CPC ..... A63B 69/3676–2069/3679
USPC ..... 473/219, 257–265
See application file for complete search history.

(56) References Cited

U.S. PATENT DOCUMENTS 5,131,659 A * 7/1992 Lindberg, Jr. ..... A63B 24/0003 359/838
5,209,484 A * 5/1993 Randall ..... A63B 69/3676 473/265
6,129,639 A * 10/2000 Brock ..... A63B 69/3676 473/260
6,755,751 B2 * 6/2004 Chapman ..... A63B 69/3667 473/229
7,597,632 B2 * 10/2009 Edwards ..... A63B 69/3641 473/257
8,029,380 B1 * 10/2011 Johansen ..... A63B 69/3676 473/257
8,808,103 B2 * 8/2014 Hart ..... A63B 53/007 473/274
2002/0016213 A1 * 2/2002 Templeton ..... A63B 69/3676 473/257
2016/0045807 A1 * 2/2016 Holland ..... A63B 69/3676 473/266

* cited by examiner

*Primary Examiner* — Laura Davison
(74) *Attorney, Agent, or Firm* — McHale & Slavin, P.A.

(57) ABSTRACT

A putting aid device for training a golfer in the skill of putting. The putting aid device is formed from transparent flexible plastic having a base with first and second side edges. Length indicia is placed on the first side edge having a first color along a length L1, a second color extending from each end of the first color a length L2, a third color extending from each end of second color a length L3, and a fourth color extending from each end of the third color a length L4. Instructional markings limit the amount of backswing and indicate proposed feet positioning. The device allows instruction for golfers that use a putting arc swing or a straight line putting swing.

10 Claims, 6 Drawing Sheets

GOLF PUTTING ALIGNMENT APPARATUS

FIELD OF THE INVENTION

This invention relates to the game of golf and more particularly to an apparatus for teaching proper putting techniques.

BACKGROUND OF THE INVENTION

The game of golf is a well known recreational sport wherein individual players progress a ball along a course using various types of clubs. The course consists of eighteen separate holes basically consisting of a tee and green section separated by a fairway. Typically stroke play is used in score keeping wherein the individual with the lowest number of strokes used to advance a golf ball over the eighteen holes is declared the winner.

No matter what type of golf match is played, eventually the ball must reach the green portion and putted into a golf ball hole so as to complete the stroke tally. For instance, a par five hole has a tee and green section separated by a fairway that can be over 500 yards long with obstacles such as water, sand, trees and so forth placed thereon. A par three hole may consist of a tee and green separated by as little as 100 yards again with obstacles placed therebetween. Driving from the tee requires strength and flexibility for proper ball placement.

A green may be small or large, but in either event putting on a green is considered easier than driving a golf ball for no power is required. Unique to the game of golf is the fact that a two inch long putt is considered one stroke; conversely a tee drive that is 360 yards long is considered one stroke. Putting on a green requires a unique form of training to develop the proper skill. A golfer who takes two or three attempts to place the golf ball in the cup will never excel in the game of golf unless and until the golfer reduces their score by mastering the art of putting Thus it is just as important to putt the golf ball as it is to drive a long ball. Ironically putting is where most golfers have the greatest difficulty. The lack of proper training will not only cost the golfer additional strokes, unless the golfer learns how to putt, the golfer will never be consistent or maintain a low handicap.

While putting is not as physically challenging as a long ball drive, technically it requires proper positioning so as to allow the putter clubface to be aligned with the desired path the golf ball is to travel. In addition it is well known that proper positioning requires the golfer to have their eyes directly over a center line and to minimize leg movement. The body and hands respond to what the eyes see and for this reason the eye and hand coordination is known to be an important function requiring golf instructors to train proper positioning to ensure optimum proficiency. If not properly positioned the golfer will attempt to steer the ball with hand movement resulting in a push or pulled putt.

To properly train an individual at golf, practice requires repetitive motions to develop muscle memory training. While an instructor can provide great insight into various golf techniques, an instructor cannot physically hold the club in a position required for proper muscle memory training.

Thus, while there are various devices to assist an individual in the proper putting technique, there is continued need for devices capable of improving an individual's golf score.

SUMMARY OF THE INVENTION

Disclosed is a putting aid device capable of seven training techniques to train a golfer in the skill of putting. The putting device can be made for use with left-handed or right-handed putters and includes instructional markings so as to limit the amount of backswing, provide feet positioning, as well as provide instruction for arc swing putters as well as straight line putters.

An objective of the invention is to provide a 7 in 1 instructional putting device that allows an individual to repeat an exact movement so as to allow muscle memory by repetitive putting in a pre-determined aligned direction.

Still another objective of the instant invention is to provide an instructional putting device that is portable allowing a golfer to practice on actual playing greens to provide positive reinforcement on feel of impact when in proper alignment.

Still another objective of the instant invention is to provide an instructional putting device that provides visual positioning of a golf putter.

Yet still another objective of the instant invention is to provide an instructional putting device having an arc to assist golfers having arc type swing.

Yet still another objective of the instant invention is to provide an instructional putting device that can be stored and shipped in a compact manner and quickly assembled for use.

Other objectives and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE PREFERRED EMBODIMENT

Figure 1:
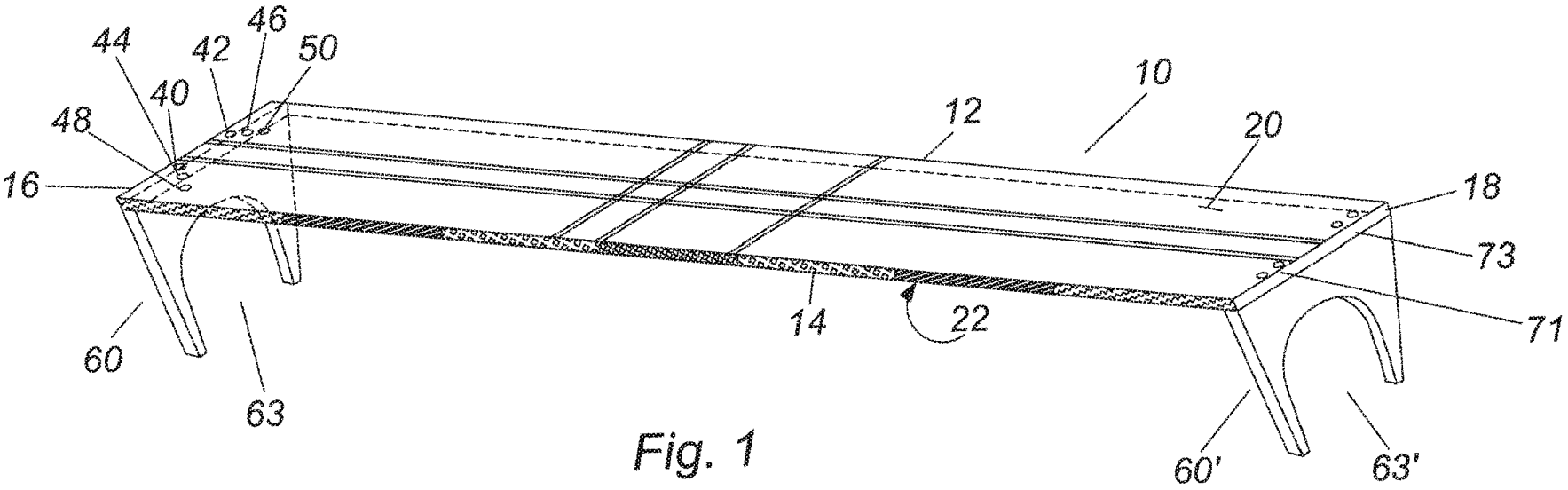
FIG. 1 is a front perspective view of the golf putting alignment device.
Figure 2:
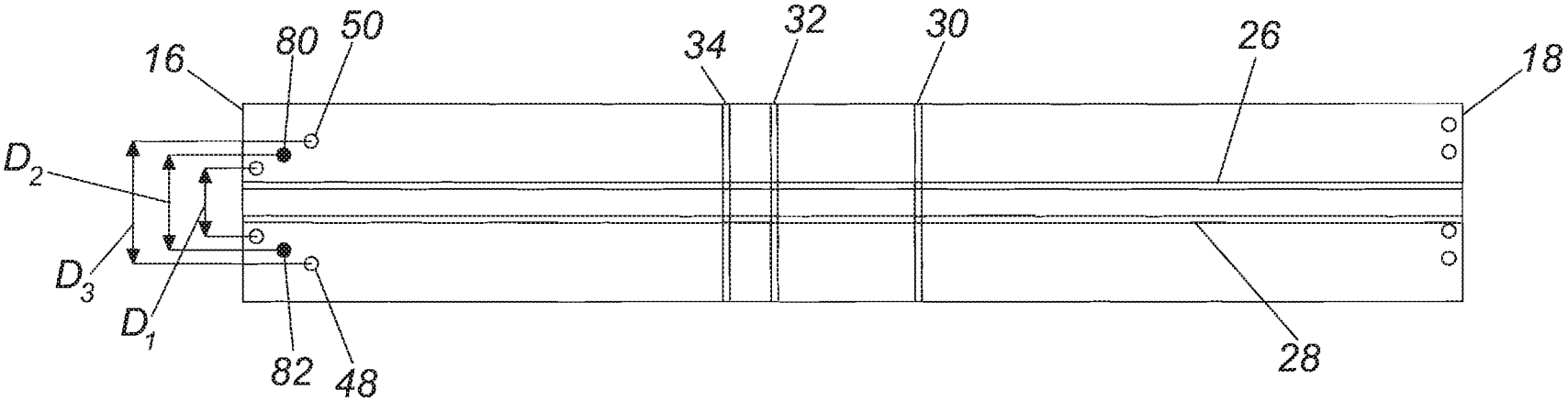
FIG. 2 is a top view thereof.

Although the invention will be described in terms of a specific embodiment, it will be readily apparent to those skilled in this art that various modifications, rearrangements and substitutions can be made without departing from the spirit of the invention. The scope of the invention is defined by the claims appended hereto.

Referring now to the drawings, the golf putting alignment apparatus of the instant invention is a kit having various components that allow for seven different training techniques. The apparatus comprises a base plate 10 formed from a piece of transparent flexible plastic having a first side edge 12 and a second side edge 14, a first end edge 16 and a second end edge 18, separating an upper surface 20 from a lower surface 22.

Track indicia is placed on the upper 20 surface of the base plate 10, the track indicia is defined as a first line 26 extending from the first end edge 16 and second end edge 18. A second line 28 is placed parallel to the first line 26 further extending from the first end edge 16 to the second end edge 18. The first and second line 26 and 28 form parallel guide lines spaced apart a distance less than the width of a conventional golf ball.

First club face indicia line 30 is formed perpendicular to the first side edge 12, and a second club face indicia line 32 is also formed perpendicular to the first side edge 12, parallel to said first club face indicia line 30. A third club face indicia line 34 is formed parallel to the second club face indicia line 32. Adjacent the first end edge 16 is a first set of apertures 40, 42 spaced apart a first distance d1, a second set of apertures 44, 46 spaced apart a second distance d2, and a third set of apertures 48, 50 spaced apart a third distance d3.

Figure 8:
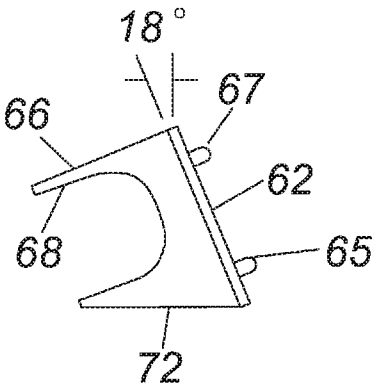
FIG. 8 is a side view of FIG. 7 in an angular position.
Figure 7:
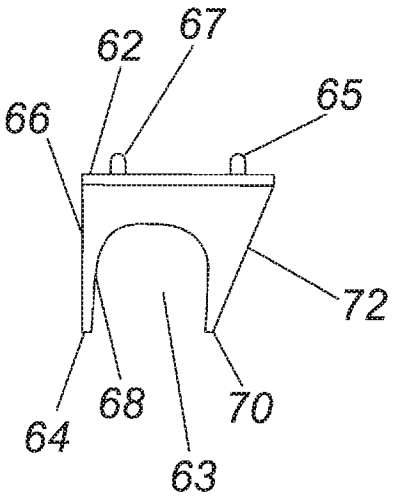
FIG. 7 is a side view of an upright stand.
Figure 10:
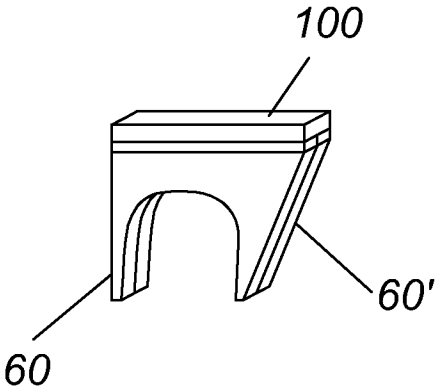
FIG. 10 is a perspective view of two stands forming a gate.
Figure 9:
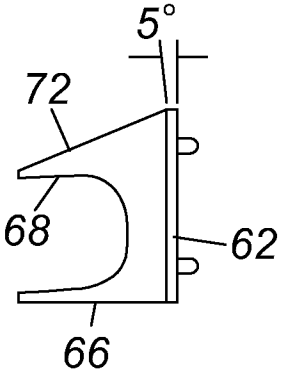
FIG. 9 is a side view of FIG. 7 in a substantially perpendicular position.

Referring to FIGS. 7-9 in general, a stand 60 having a top surface 62 releasably securable to the bottom surface 22 of a base plate 10 along end edge 16. The top surface has at least two protrusions 65,67 constructed and arranged to frictionally engage apertures 40,42; 44,46; or 48,50 on the first end 16. Similarly the second end 18 includes apertures 71, 73 for receipt of a similar shaped stand 60'. Each stand 60 has a first leg 64 having an outer edge 66 formed perpendicular to the top surface 62 and an inner edge 68 forming a continuous U-shaped edge wall extending to a second leg 70. The second leg 70 an angular edge wall 72 forming an acute angle to the bottom surface 22 of the base plate 10. A second stand 60' of the same shape as the first stand 60 is releasably securable to the bottom surface 22 of the base plate 10 along end edge 18. Stands 60 and 60' allow positioning of the base plate 10 in an elevated position allowing movement of a golf ball and putter head beneath the base plate. The transparent base plate 10 provides clear viewing of a golf ball and putter head for practice. Spheres 80, 82 such as marbles, are part of the apparatus and used in training by placement with end 16 apertures 40, 42 or 44, 46 or 48, 50 to provide visual alignment of the golf ball departure from the base plate 10.

Figure 3:
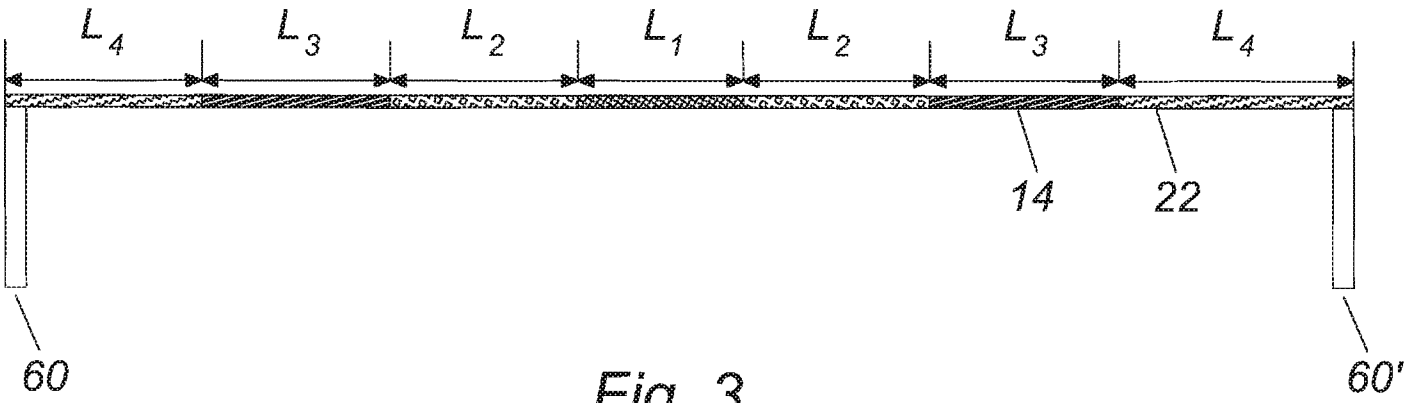
FIG. 3 is a first side view illustrating a substantially perpendicular position.
Figure 4:
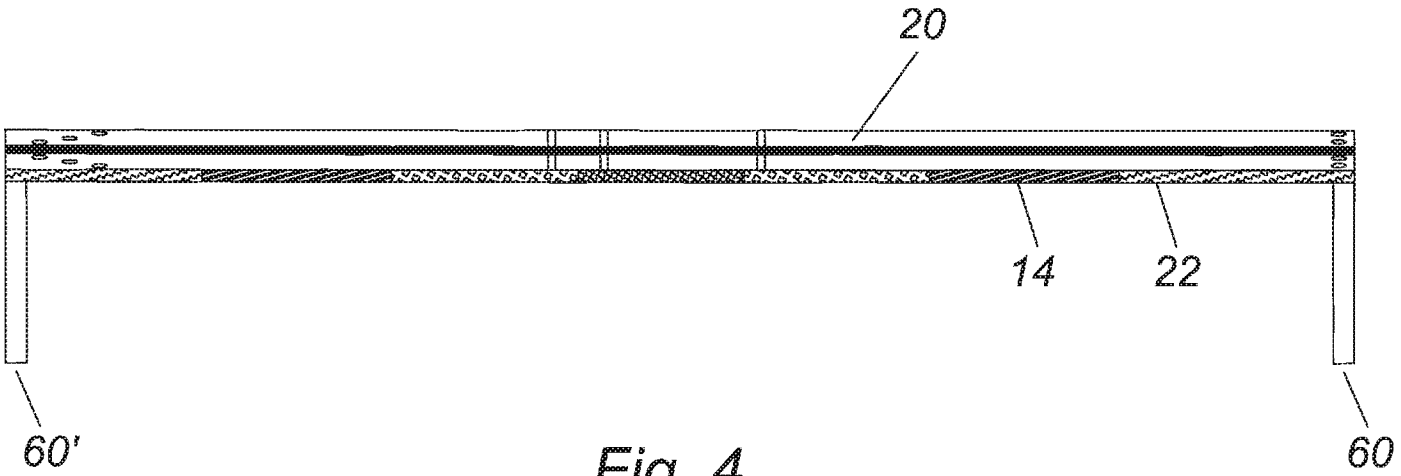
FIG. 4 is a second side view of FIG. 3 illustrating a 72° position.
Figure 5:
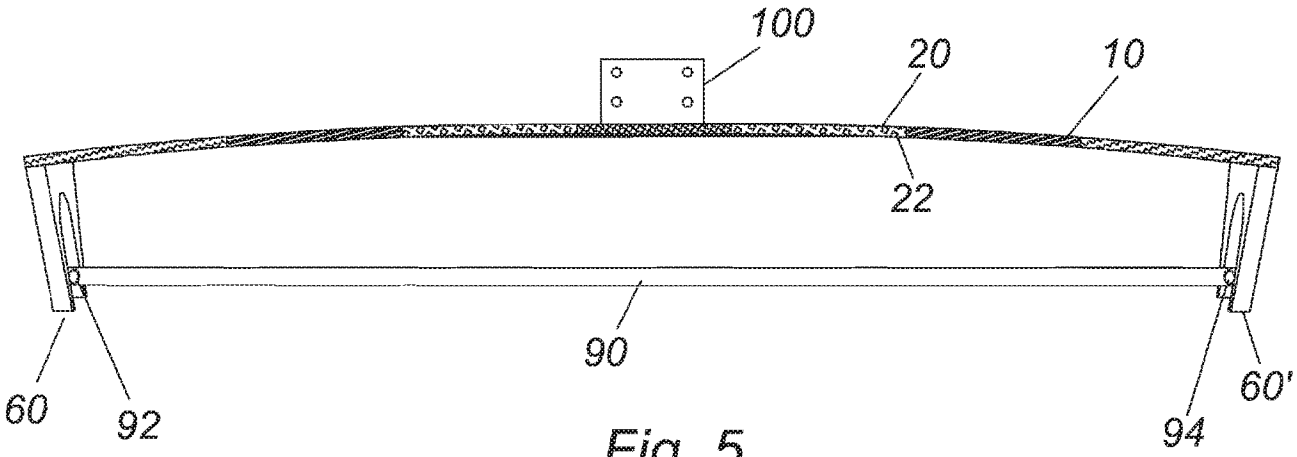
FIG. 5 is a first side view of a curved base plate illustrating a substantially perpendicular position.
Figure 6:
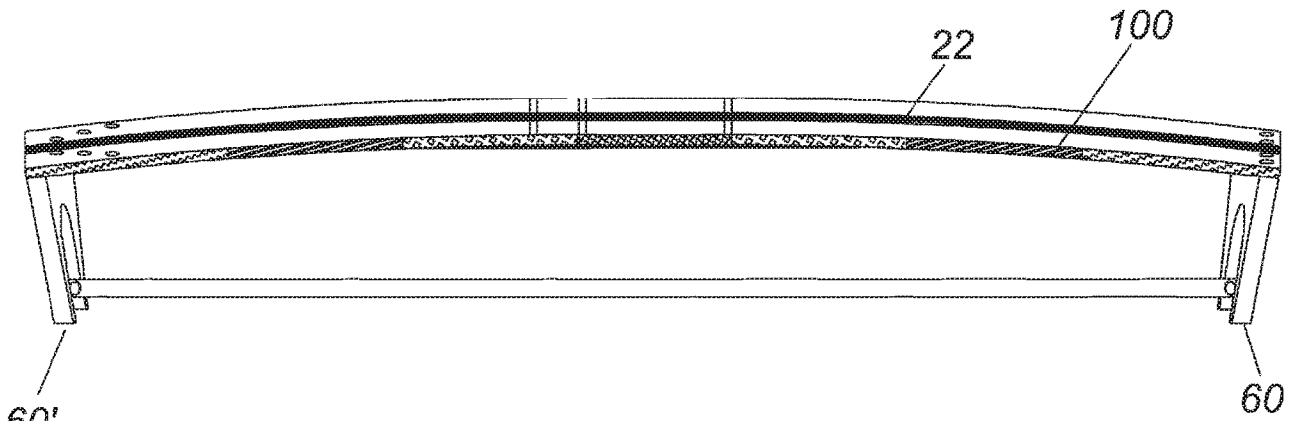
FIG. 6 is a second side view of FIG. 5 illustrating a curved 72° position.

Referring to FIGS. 3-6, length indicia is placed on the first side edge 14. A first color is centrally disposed along a length L1. A second color extends from each end of the first color a length L2. A third color extends from each end of the second color a length L3. A fourth color extends from each end of the third color a length L4. A fifth color extends from the fourth color a length L5. As illustrated in FIG. 3, the base plate 10 is in a substantially perpendicular position relative to the ground; an angle of about 5 degrees allows practice by a golfer in a substantially upright position using a straight putting configuration. FIG. 4 reverses the base plate 10 wherein the stands 60 and 60' provide the upper surface 20 with about a 72 degree angular rake. The angular rake allows a golfer that prefers offset putting to follow the proper path. FIG. 5 depicts base plate 10 in a substantially perpendicular position to the ground with a curvature induced by a spreader bar 90 having a fastener 92 to secure to first stand 60, and a like fastener 94 to secure to second stand 60'. The spreader bar 90 placing the stands 60, 60' in a spaced apart position causing the curvature as depicted while maintaining the 85 degree upper surface angle illustrated in FIG. 5 and the 72 degree upper surface angle illustrated in FIG. 6. FIG. 6 reverses the base plate 10 depicted in FIG. 5 wherein the stands 60 and 60' provide the upper surface 20 with about a 72 degree angular rake. The angular rake allows a golfer that prefers offset and includes an arc path to properly follow the path. A reflective material such as a mirror 100 can be placed beneath the putting path providing the golfer with a reflective line of sight device to assure proper positioning of the golfer's head.

(A) Correct Line practice technique is a configuration that allows for proper face angle at set up by showing putter face square to edge. In this configuration the base plate 10 is lying flat on a green. A golf ball is positioned between the first and second guide lines 26 and 28, and the face of a putter is aligned by abutting an end edge 16 or 18 before the golf ball is moved between the first and second guide lines 26 and 28. The teaching technique provides feedback as to ball roll (cut-hook-forward roll) and allows for positive attack angle of 1.5 degrees to 2 degrees.

(B) Tutor effect practice is a configuration that allows for instant interruption of an improperly putted golf ball. With the aid of the base plate 10 lying flat on the green, and lined up to the target, a golf ball is placed onto the plate 10 in front of indicia line 34. The spheres 80,82 are placed in the chosen apertures at the end 16 of the plate 10 closest to the target. The golfer aligns a golf putter face on the indicia line 34, squaring the face of golf putter face to the target. A ball properly struck will have little to no side spin and will pass through the opening of the spheres 80,82. Any spin caused upon the golf ball will cause impact with one of the spheres. The pair of spheres positionable in said first, said second or said third apertures.

(C) Low Path practice technique is a configuration that allows for a golfer to practice a low back and through stroke encouraging a better attack angle. If the golf ball is struck off center on the heel or toe of the putter, the golf ball will not pass through the U-shaped opening which forms a gate 63 or 63'. The first and second guide lines 26 and 28 give reference for stoke distance and club face indicia lines 30,32 or 34 providing putter face alignment.

(D) 85 degree angle provides placement of the base plate 10 on a side edge as depicted in FIGS. 3 and 5. The 85° configuration allows practice of a straight back and straight through stoke. The stroke distance meter provided by the length indicia is visible allowing practice of matching the colors during the backward movement of the putter head to one set of colors and forward movement to a matching color to assure follow through. This technique allows a golfer to learn speed control.

(E) 72 degree angle provides placement of the base plate on a side edge as depicted in FIGS. 4 and 6. The 72° configuration allows practice of an arched path while still seeing the stroke distance meter colored markings for the length. The golfer can choose to increase or decrease the amount of arc needed to improve their path. The 72° lie angle configuration allows the putter to be brought back slightly inside the path line and return squarely to the golf ball. The surface of the base plate allows for a smooth transition as the putter is taken back, upon impact, and during follow through. The stroke distance meter on the edge gives a reference for distance control during the putting stroke. Length indicia is visible allowing practice of matching the colors during the backward movement of the putter head to one set of colors and forward movement to a matching color to assure follow through.

(F) The base plate 10 may further be used as a stimp meter to illustrate the true roll of the ball and put the line on the putt. This use of the base plate 10 will also allow the golfer to visual determine the speed of the green giving an actual image of the putt before the golfer takes a stroke.

(G) The placement of a mirror 100 beneath the putter head provides positive reinforcement as to the location of the putter head in relation to the golfer's head and eye position. The mirror provides a simply method of determining the alignment of the putter head. For instance, when the face of the putter cannot be seen directly, or by reflection, the individual's eye is focused directly above the face of the putter.

(H) The stands 60 & 60' can further be used a putting gates allowing the golfer to practice getting started on the proper line. If the ball is not struck squarely it will not pass through the gates.

It is to be understood that while I have illustrated and described certain forms of my invention, it is not to be limited to the specific forms or arrangement of parts herein described and shown. It will be apparent to those skilled in the art that various changes may be made without departing from the scope of the invention and the invention is not to be considered limited to what is shown in the drawings and described in the specification.

What is claimed is:

1. A golf putting alignment apparatus comprising:

a base plate formed from a piece of transparent flexible plastic, said base having first and second side edges, first and second end edges, separating an upper surface from a lower surface;

length indicia placed on said first side edge, said indicia having a first color centrally disposed along a length L1 of said first side edge, a second color extending from each end of said first color a length L2 along said first side edge, a third color extending from each end of said second color a length L3 along said first side edge, and a fourth color extending from each end of said third color a length L4 along said first side edge;

track indicia placed on said upper or said lower surface of said base plate, said track indicia formed from two tracks spaced apart and extending from said first end edge to said second end edge;

a first and second stand, each said stand having a top surface releasably securable to said lower surface of said base plate, each said stand having a first leg with an outer edge formed perpendicular to said top surface and an inner edge forming a continuous edge wall extending to a second leg forming a U-shaped opening therebetween, said second leg having an angular edge forming an acute angle to said bottom surface of said base plate.

2. The golf putting alignment apparatus according to claim 1 including wherein said two tracks are parallel lines and spaced apart a distance less than the width of a conventional golf ball.

3. The golf putting alignment apparatus according to claim 1 including a first club face indicia line formed perpendicular to a first end of said first color and a second club face indicia line formed perpendicular to a second end of said first color.

4. The golf putting alignment apparatus according to claim 3 including a third club face indicia line formed parallel to said second club face indicia line.

5. The golf putting alignment apparatus according to claim 1 wherein said first stand is interchangeable with said second stand.

6. The golf putting alignment apparatus according to claim 1 including a first pair of apertures formed along said first end edge and spaced apart a distance d1; a second pair of apertures formed along said first end edge and spaced apart a distance d2; and a third pair of apertures formed along said first end edge and spaced apart a distance d3.

7. The golf putting alignment apparatus according to claim 6 including a pair of spheres positionable in said first, said second or said third apertures.

8. The golf putting alignment apparatus according to claim 1 wherein the acute angle of the angular edge is 72 degrees.

9. The golf putting alignment apparatus according to claim 1 wherein each said stand includes at least two protrusions extending from said top surface, each said protrusion constructed and arranged to insert in an aperture formed in said base plate.

10. The golf putting alignment apparatus according to claim 1 including a reflective mirror, wherein said mirror is placed along an edge of said base plate to provide visual alignment of a putter club face.

* * * * *